US005720841A

United States Patent [19]

Lamotte et al.

[11] Patent Number: 5,720,841

[45] Date of Patent: Feb. 24, 1998

[54] NEW TYPE OF THERMAL IMAGING MEDIUM AND METHOD OF FORMING AN IMAGE WITH IT

[75] Inventors: Johan Lamotte, Rotselaar; Rudi De Busser, Bouwel, both of Belgium

[73] Assignee: Agfa-Gevaert, Belgium

[21] Appl. No.: 709,278

[22] Filed: Sep. 6, 1996

[30] Foreign Application Priority Data

Sep. 14, 1995 [EP] European Pat. Off. ..... 95202486

[51] Int. Cl.[6] ..... B41M 5/40

[52] U.S. Cl. ..... 156/235; 156/240; 156/277; 428/195; 428/212; 428/500; 428/520; 430/200

[58] Field of Search ..... 156/230, 235, 156/239, 240, 277; 428/195, 212, 500, 913, 914; 430/200, 945

[56] References Cited

U.S. PATENT DOCUMENTS 4,157,412 6/1979 Deneau .

*Primary Examiner*—Bruce H. Hess

*Attorney, Agent, or Firm*—Brumbaugh, Graves, Donohue & Raymond

[57] ABSTRACT

A new type of positive working thermal imaging medium, and a process of forming an image with it is disclosed. This thermal imaging medium comprises a transparent support and (1) a layer comprising a homopolymer or copolymer comprising at least 60 mole % of monomer units containing covalently bound chlorine, (2) a layer containing a homopolymer or copolymer comprising at least 50 mole % of a vinyl acetal monomer unit, (3) an image forming layer, (4) a release layer, and (5) a thermoadhesive layer. After or before exposure to a heat pattern generated directly by a thermal head or indirectly by information-wise exposure to laser radiation a cover sheet is laminated to layer (5). After delamination a positive image is obtained on the original support.

14 Claims, No Drawings

NEW TYPE OF THERMAL IMAGING MEDIUM AND METHOD OF FORMING AN IMAGE WITH IT

FIELD OF THE INVENTION

The present invention relates to a new type of thermal imaging medium and to a method for obtaining images with it showing improved physical properties.

BACKGROUND OF THE INVENTION

Conventional photographic materials based on silver halide are used for a large variety of applications. For instance, in the pre-press sector of graphic arts rather sensitive camera materials are used for obtaining screened images. Scan films are used for producing colour separations from multicolour originals. Phototype setting materials record the information fed to phototype- and image setters. Relative insensitive photographic materials serve as duplicating materials usually in a contact exposure process. Other fields include materials for medical recording, duplicating and hard copy, X-ray materials for non-destructive testing, black-and-white and colour materials for amateur- and professional still photography and materials for cinematographic recording and printing.

Silver halide materials have the advantage of high potential intrinsic sensitivity and excellent image quality. On the other hand they show the drawback of requiring several wet processing steps employing chemical ingredients which are suspect from an ecological point of view.

In the past several proposals have been made for obtaining an imaging element that can be developed using only dry development steps without the need of processing liquids as it is the case with silver halide photographic materials.

A dry imaging system known since quite a while is 3M's dry silver technology. It is a catalytic process which couples the light-capturing capability of silver halide to the image-forming capability of organic silver salts.

Another type of non-conventional materials as alternative for silver halide is based on photopolymerisation. The use of photopolymerizable compositions for the production of images by information-wise exposure thereof to actinic radiation is known since quite a while. All these methods are based on the principle of introducing a differentiation in properties between the exposed and non-exposed parts of the photopolymerizable composition e.g. a difference in solubility, adhesion, conductivity, refractive index, tackiness, permeability, diffusibility of incorporated substances e.g. dyes etc.. The thus produced differences may be subsequently employed in a dry treatment step to produce a visible image and/or master for printing e.g. a lithographic or electrostatic printing master.

As a further alternative for silver halide chemistry dry imaging elements are known that can be image-wise exposed using an image-wise distribution of heat. Several types of such thermal imaging media are known. When the heat pattern is indirectly generated by the conversion of radiation, e.g. laser radiation, into heat these types of dry imaging elements are called heat mode materials. When the heat pattern is provided directly, e.g. by means of a thermal head, these elements are called thermal recording materials or thermographic materials. Both types of elements offer the advantage in addition to an ecological advantage that they do not need to be handled in a dark room nor is any other protection from ambient light needed. Heat mode recording materials, based on change of adhesion, are disclosed in e.g.

U.S. Pat. No. 4,123,309, U.S. Pat. No. 4,123,578, U.S. Pat. No. 4,157,412, U.S. Pat. No. 4,547,456 and PCT publ. Nos. W0 88/04237 and W0 93/03928, and international appl. No. PCT EP94/02063. In a preferred embodiment such a thermal imaging medium comprises a transparent support and an imaging layer containing carbon black, optionally additional layers and a stripping sheet. By the conversion of intense laser light into heat on information-wise exposure a surface part of the support liquefies and firmly locks the carbon black, so that after delamination a negative carbon black image is formed on the support.

The thermal imaging media described in the previous paragraph are based on a selective increase of adhesion in the exposed parts. Still further thermal imaging systems exist that are based on image-wise ablation. This selective ablation can be caused by chemical decomposition, e.g. in systems containing nitrocellulose layers, or by gas formation, e.g. a chemical release of nitrogen or carbon dioxide. A reference on systems based on ablation is e.g. U.S. Pat. No. 5,156,938.

With several kinds of imaging materials that are exposed by specular laser radiation through a transparent support the following problem arises. Transparent polymeric resin supports such as polyethylene terephthalate supports tend to contain microscopic dust particles, or catalyst rest particles, or microscopic voids (so-called fish-eyes) which scatter the incoming laser beam so that it does not reach the radiation sensitive layer anymore with the proper power. In negative working systems this leads to the formation of so-called pinholes; in positive working systems it may cause the formation of small spots. The same phenomenon is caused by the presence of dust or scratches on the surface of the support or in the optionally present subbing layer. This defect is particularly striking in negative working heat mode systems, based on change of adhesion as described above, where the pinholes become apparent after the delamination step. The defect is most disturbing in recorded full areas, where the pinholes appear as tiny white spots on a black background, and less in recorded separate lines and dots. These pinholes give the obtained image an unsatisfactory outlook, and, moreover, are functionally disturbing for the further practical application of the finished image, e.g. as a master for the exposure of a printing plate.

It is the object of the present invention to provide an alternative type of thermal imaging medium, and a method for the formation of an image with it that is substantially free of pinholes.

SUMMARY OF THE INVENTION

The object of the present invention is realized by providing a process for the formation of a heat mode image, comprising the following steps:

(a) exposing information-wise to laser radiation or to heat generated by a thermal head a thermal imaging medium comprising a transparent support and the following layers:
  (1) a layer comprising a homopolymer or copolymer comprising at least 60 mole % of monomer units containing covalently bound chlorine,
  (2) a layer containing a homopolymer or copolymer comprising at least 50 mole % of a vinyl acetal monomer unit,
  (3) an image forming layer containing an image forming substance and, in case of laser exposure in step (a), a compound capable of transforming laser radiation into heat, said compound being the same or different from said image forming substance, (4) a release layer, (5) a thermoadhesive layer, (b) laminating a cover sheet to said thermoadhesive layer (5), with the proviso that the order of steps (a) and (b) can be reversed, and (c) peeling-apart said support and said cover sheet whereby at least the layers (1), (2) and (3) adhere to said support in the information-wise non-exposed parts, and whereby the layers (2). (3), (4) and (5) adhere to said cover sheet in the information-wise exposed parts thus forming a positive image on said support and a negative image on said cover sheet.

Contrary to the heat mode materials cited in the background section the thermal imaging medium of the present invention functions according to a mechanism based on a selective decrease of adhesion in the exposed parts without being ablative. Instead of a negative image a positive one is formed on the original support. Essential thereto is the presence of the layers (1) and (2) as defined above between the support and the image forming layer.

DETAILED DESCRIPTION OF THE INVENTION

As transparent support for the thermal imaging medium for use in the present invention polyethylene terephthalate is preferred. However other transparent polymeric resins, e.g. polycarbonate, polyethylene, polypropylene or polystyrene can be used.

It is essential for the successful practice of this invention that on top of the transparent support a layer (1) is applied containing a homopolymer or copolymer composed of one or more monomers containing covalently bound chlorine for at least 60 mole % in total. Most preferably, this chlorine content is at least 80 mole %. Suitable chlorine containing polymers are e.g. polyvinyl chloride, polyvinylidene chloride, a copolymer of vinylidene chloride, an acrylic ester and itaconic acid, a copolymer of vinyl chloride and vinylidene chloride, a copolymer of vinyl chloride and vinyl acetate, a copolymer of butylacrylate, vinyl acetate and vinyl chloride or vinylidene chloride, a copolymer of vinyl chloride, vinylidene chloride and itaconic acid, a copolymer of vinyl chloride, vinyl acetate and vinyl alcohol, chlorinated polyethylene, polychloroprene and copolymers therof, chlorosulfonated polyethylene, polychlorotrifluoroethylene, polymethyl-alpha-chloroacrylate etc. A preferred chlorine containing polymer is co(vinylidenechloride-methylacrylate-itaconic acid; 88%/10%/2%).

The amount of the chlorine containing polymer is preferably comprised between 0.16 and 0.24 g/m$^2$.

Other optional ingredients of layer (1) are colloidal silica and wetting agents. The dry thickness of the layer is preferably comprised between 0.1 and 0.5 g/m$^2$, most preferably between 0.2 and 0.3 g/m$^2$.

Another essential feature for the successful practice of the present invention is the presence on top of layer (1) of a layer (2) containing a homopolymer or copolymer comprising at least 50 mole % of a vinyl acetal monomer, more preferably at least 70 mole %. In a most preferred embodiment this vinyl acetal monomer is vinyl butyral. Commercial types of (co)polymers containing a major fraction of vinyl butyral are e.g. the BUTVAR types 72, 74, 76, 79, 90 and 98, all marketed by Monsanto Co., the types SLEC BL1, BM2, BM5, BXL and BX5 from Sekisui Plastics Co., MOWITAL B30HH from Hoechst AG, Pioloform BM18 from Wacker Chemie, and VINYLITE LM and VINYLITE XYHL marketed by Bakelite Corp.. Usually these commercial copolymers further contain a small fraction of poly(vinyl acetate) (<5 mole %), the rest being poly(vinyl alcohol). The composition and some physical characteristics of copolymers of this kind will be illustrated in example 2 furtheron.

The amount of the vinyl acetal containing polymer in layer (2) is preferably comprised between 0.05 and 1 g/m$^2$.

Layer (2) is preferably coated from an organic solvent or solvent mixture, such as methylethylketone/ethanol or toluene/ethanol. A preferred solvent is a mixture of methylethylketone and ethanol.

Layer (2) can further contain solid particles controlling the cohesive strenght, e.g. silica particles such as TOSPEARL 103 and 105 (Toshiba), SEAHOSTAR P50 (Nippon Shokubai), LAPONITE RD and RDS (Laporte Industries Ltd), WACKER HDK130 (Wacker Chemie) and AEROSIL R812 (Degussa). It can further contain coating aids such as BAYSILON LACKADDITIV MA (Bayer AG), FLUORAD FC430 van (3M Co.) and SILICON FLUID LO54 (Wacker Chemie). Other optional ingredients are thermo-acids and chlorine containing polymers with the purpose of setting free additional $Cl^-$for enhanced sensitivity such as triazine (PCAS) or VICLAN A85 (ICI). Finally, thickening agents can be present such as nitrocellulose E1440 (Walsroder) and plasticizers such as dibutylphthalate.

The dry thickness of layer (2) is preferably comprised between 0.05 and 1 μm, most preferably between 0.1 and 0.2 μm.

In principle, the layer order of layers (1) and (2) can be reversed.

In the image forming layer (3) the image forming substance is preferably a pigment, e.g. a magnetic pigment, e.g. iron oxides, a coloured piment, e.g. copper phtalocyanine, or metal particles. However, the most preferred pigment is carbon black. It can be used in the amorphous or in the graphite form. The preferred average particle size of the carbon black ranges from 0.01 to 1 μm. Different commercial types of carbon black can be used, preferably with a very fine average particle size, e.g. RAVEN 5000 ULTRA II (Columbian Carbon Co.), CORAX L6, FARBRUSS FW 2000, SPEZIALSCHWARZ 5, SPEZIALSCHWARZ 4A, SPEZIALSCHWARZ 250 and PRINTEX U (all from Degussa Co.).

When in accordance with the present invention the information-wise heat pattern is generated by a thermal head then a compound capable of transforming laser radiation into heat need not to be present. However, in the preferred embodiment of this invention, wherein the heat pattern is generated by the conversion of laser radiation into heat, the presence of such compound is indispensable. When using carbon the image forming substance and the compound transforming intense laser radiation into heat is one and the same product. When however the image forming substance is not absorptive for the laser radiation, which is preferably infra-red laser radiation, an additional compound, preferably an infra-red absorbing compound is required for transforming the radiation into heat. This infra-red absorbing compound can be a soluble infra-red absorbing dye or a dispersable infra-red absorbing pigment. Infra-red absorbing compounds are known since a long time and can belong to several different chemical classes, e.g. indoaniline dyes, oxonol dyes, porphine derivatives, anthraquinone dyes, merostyryl dyes, pyrylium compounds and sqarylium derivatives.

A suitable infra-red dye can be chosen from the numerous disclosures and patent applications in the field, e.g. from U.S. Pat. Nos. 4,886,733, 5,075,205, 5,077,186, 5,153,112, 5,244,771, from Japanese unexamined patent publications (Kokai) No.'s 01-253734, 01-253735, 01-253736, 01-293343, 01-234844, 02-3037, 02 4244, 02-127638, 01-227148, 02-165133, 02-110451, 02-234157, 02-223944, 02-108040, 02-259753, 02-187751, 02-68544, 02-167538, 02-201351, 02-201352, 03-23441, 03-10240, 03-10239, 03-13937, 03-96942, 03-217837, 03-135553, 03-235940, and from the European published patent applications publ. No.'s 0 483 740, 0 502 508, 0 523 465, 0 539 786, 0 539 978 and 0 568 022, and from European patent application appl. No. 94200797. This list is far from exhaustive and limited to rather recent disclosures.

In principle, the infra-red absorbing compound can also be present in layer (1) and/or (2).

It will be clear that mixtures of pigments, or mixtures of one or more pigments and one or more compounds transforming radiation into heat can be used.

As binders for the image forming layer gelatin, polyvinylpyrrolidone, polyvinylalcohol, hydroxyethylcellulose, polyethyleneoxide and a broad variety of polymer latices can be considered. These latices can be film forming or non-film forming. They can comprise acid groups as a result of which they can swell in an alkaline coating medium and/or become totally or partially soluble. In this way the layer properties can be strongly influenced so that less coating and drying point defects will appear. When choosing a particular type of carbon black and a particular type of polymeric binder the ratio of the amounts of both has to be optimized for each case. The preferred binder is gelatin.

The thickness of the image forming layer is preferably comprised between 0.5 and 1.5 micron.

The release layer (4) contains a binder and one or more of the typical ingredients for release layers known in the art such as waxes, polyethylene, silicones, fluorinated polymers such as Teflon, silica particles (e.g. SEAHOSTAR KE types, Nippon Shokukai Co), colloidal silica, polymeric beads (e.g. polystyrene, polymethylmethacrylate), hollow polymeric core/shear beads (e.g. ROPAQUE particles, Rohm and Haas Co), beads of siliconised pigments like siliconised silica (e.g. TOSPEARL types, Toshiba Silicones Co), and matting agents. In a particularly preferred embodiment of the present invention the release layer contains a mixture of polyethylene and Teflon. The preferred coverage of the release layer ranges between 0.1 and 3 g/m$^2$.

The adhesive layer (5) is a thermal adhesive layer (or thermoadhesive layer, or TAL) containing one or more thermoadhesive polymers preferably having a glass transition temperature $T_g$ comprised between 20° and 60° C. For ecological and practical reasons the TAL is preferably coated from an aqueous medium. Therefore the polymers are preferably incorporated as latices. Other additives can be present into the TAL to improve the layer formation or the layer properties, e.g. thickening agents, surfactants, levelling agents, thermal solvents and pigments.

Preferred latices are styrene-butadiene latices. These latices can contain other comonomers which improve the stability of the latex, such as acrylic acid, methacrylic acid and acrylamide. Other possible polymer latices include polyvinylacetate, copoly(ethylene-vinylacetate), copoly (acrylonitrile-butadiene-acrylic acid), copoly(styrene-butylacrylate), copoly(methylmethacrylate-butadiene), copoly(methylmethacrylate-butylmethacrylate), copoly (methylmethacrylate-ethylacrylate), copolyester(terephtalic acid-sulphoisophtalic acid-ethyleneglycol), copolyester (terephtalic acid-sulphoisophtalic acid-hexanediol-ethyleneglycol).

Particularly suitable polymers for use in the TAL layer are the BAYSTAL polymer types, marketed by Bayer AG, which are on the basis of styrene-butadiene copolymers. Different types with different physical properties are available. The styrene content varies between 40 and 80 weight %, while the amount of butadiene varies between 60 and 20 weight %; optionally a few weight % (up to about 10%) of acrylamide and/or acrylic acid can be present. Most suited are e.g. BAYSTAL KA 8558, BAYSTAL P2000 (earlier named BAYSTAL KA 8522), BAYSTAL S30R and BAYSTAL P1800 because they are not sticky at room temperature when used in a TAL layer. Other useful polymers are the EUDERM polymers, also from Bayer AG, which are copolymers comprising n.-butylacrylate, methylmethacrylate, acrylonitrile and small amounts of methacrylic acid.

Alternatively to direct coating on top of the release layer the TAL can be coated on a separate temporary support. In that case the TAL is laminated to the release layer and then the temporary support is removed by delamination.

The cover sheet (or "stripping sheet" or "counterfoil") can be laminated or adhered by pressure to the thermoadhesive layer (5) after or before the information-wise exposure to laser radiation or to a thermal head. When the cover sheet is a transparent sheet it can be composed of any of the same polymeric resins suitable for use as support. As for the support a polyethylene terephthalate sheet is preferred. Its thickness is preferably comprised between 10 and 200 micron. Preferably it is somewhat thinner than the support for ecological reasons. The cover sheet itself can be provided with a subbing layer. In principle, the stripping sheet can also be an opaque sheet such as a paper base, e.g. a plain paper base or a polyethylene coated paper. However, a transparent cover sheet is preferred since the exposure can then be performed through any of both sides, although exposure through the support bearing layer (1) is preferred.

In the preferred embodiment the thermal image medium as described above is exposed information-wise by means of an intense laser beam. The laser type can be chosen from a gas laser, a dye laser or a solid state laser, preferably an infra-red emitting laser. In the latter case the radiation to heat converting compound is an infra-red absorbing compound. Especially preferred lasers are semiconductor diode lasers or solid state lasers such as a Nd-YAG laser emitting at 1064 nm, or a Nd-YLF laser emitting at 1053 nm.. Other possible infra-red laser types include diode lasers emitting at 780 or 823 nm or diode lasers emitting at 985 nm. Important parameters of the laser recording are the spot diameter (D) measured at the $1/e^2$ value of the intensity, the applied laser power on the film (P), the recording speed of the laser beam (v) and the number of dots per inch (dpi).

As stated above the lamination of the stripping sheet to the TAL can be performed before or after exposure. Lamination may be conducted by putting the two materials in contact and then introducing the materials into the nip of a pair of heated laminating rollers under suitable pressure. Suitable laminating temperatures usually range from approximately 60° C. to 120° C., preferably from 70° C. to 100° C.

Without willing to be bound by theory it is believed that by the direct or indirect application of heat the chlorine containing polymer of layer (1) is partially decomposed under the release of HCl which decomposes the vinyl acetal containing polymer of layer (2) thereby reducing the adhesion between this layer (2) and layer (1).

Finally the heat mode image is dry developed by delamination. This can be performed manually or in a delamination apparatus. In a preferred way of doing the stripping layer is held planar and the medium is peeled off at an angle of about 180° at a speed of about 10 m/min. As a result at least the layers (1), (2) and (3) adhere to the original support in the information-wise non-exposed parts, and the layers (2), (3), (4) and (5) adhere to the cover sheet in the information-wise exposed parts thus forming a positive image on the support and a negative image on the cover sheet. Optionally the images can be protected by means of a protective layer or laminate.

When the recorded information is provided by a phototype- or image-setter the heat mode image(s) can be used as masters for the exposure of a printing plate or a graphic arts contact material.

The finished image can also be used for direct visual inspection, e.g. when the recorded information serves as a hard copy of medical radiographic information.

The present invention will be illustrated by the following examples without however being limited thereto.

EXAMPLES

Example 1

To a polyethylene terephthalate film support were coated in the order given (1) a Cl-containing layer
(2) a BUTVAR layer
(3) a carbon black layer
(4) a release layer
(5) a thermoadhesive layer The composition of each of these layers is shown in table 1.

TABLE 1

| sample: I | | |
|---|---|---|
| layer | compound | g/m² |
| (1) | copoly(vinylidenechloride-methylacrylate-Itaconic acid; (88/10/2)) | 0.08 |
| | $SiO_2$ | 0.02 |
| (2) | BUTVAR B-98 (Monsanto) | 0.2 |
| (3) | carbon black (CORAX L6, Degussa Co) | 0.9 |
| | copoly(ethylacrylate-methylmethacrylate-methacrylic acid; 37.0/46.5/16.5) (pH = 9) | 0.72 |
| | conventional wetting agent ULTRAVON | 0.38 |

TABLE 1-continued

| sample: I | | |
|---|---|---|
| layer | compound | g/m² |
| (4) | polyethylene (HORDAMMER PEO2, marketed by Hoechst AG) | 0.5 |
| | TEFLON (HOSTAFLON TF5032, marketed by Hoechst AG) | 0.25 |
| | copoly(styrene-butadiene-acrylic acid) (BAYSTAL, purchased from Bayer AG) | 0.75 |
| (5) | copoly(styrene-butadiene-acrylic acid) (BAYSTAL, purchased from Bayer AG) | 25 |

Layer (2) is coated out of a 1% solution of a mixture of methylethylketone and ethanol (80/20).

The above prepared heat mode element was exposed information-wise, using a test pattern, through the polyester support by means of Nd-YAG solid state laser having an output power of 1.6 Watt and an emission wavelenght of 1064 nm. A test pattern was written at 212 lines per inch with an adressability of 2400 dots per inch.

A polyethylene terephthalate counterfoil with a subbing layer was laminated to the thermoadhesive layer. A roller laminator (type LPP650 of Dorned Co, The Netherlands) was used. The roller temperature was 85° C. The lamination speed was 0.4 m/min. The pressure between the rollers corresponded to a impression of 1.5 mm.

When peeling-off the PET-support the thermoadhesieve layer together with the release layer, the carbon layer and the BUTVAR layer were removed from the PET support at the exposed areas of the test pattern. In the non-exposed parts the carbon containing layer and a part of the release layer remained at the PET support, while the thermoadhesive layer and the other part of the release layer were removed.

In this way a positive image without pinhole defect was formed at the PET-support and a negative image is formed at the PET-counterfoil.

The resolution of these materials ranged from 4 to 96% dot.

Example 2

The same procedure as described for sample I (example 1) was followed with the difference that other types of BUTVAR were used in layer (2). These types of BUTVAR are shown in table 2.

TABLE 2

| | | Composition | | | | | |
|---|---|---|---|---|---|---|---|
| Sample | Trade name | pVi Butyral % | pViOH (%) | pViOAc (2) | M.G. | Tg (°C.) | Firm |
| II.1 | B72 | 80 | 17,5–20,0 | 0–0,5 | 170–250 | | Monsanto |
| II.2 | B74 | 80 | 17,5–20,0 | 0–0,5 | 120–150 | | Monsanto |
| II.3 | B76 | 88 | 11,0–13,0 | 0–1,5 | 90–120 | 59,0 | Monsanto |
| II.4 | B79 | 88 | 10,5–13,0 | 0–1,5 | 50–80 | | Monsanto |
| II.5 | B90 | 80 | 18,0–20,0 | 0–15 | 70–100 | 61,5 | Monsanto |
| II.6 | B98 | 80 | 18,0–20,0 | 0–2,5 | 40–70 | 55° C. | Monsanto |
| II.7 | Slec BL1 | 72 ± 3 | 26 ± 5 | <4 | | 90° C. | Sekisui Plastics |
| II.8 | Slec BM2 | 76 ± 3 | 22 ± 5 | <4 | | 90° C. | Sekisui Plastics |
| II.9 | Slec BM5 | 74 ± 3 | 24 ± 5 | <4 | | | Sekisui Plastics |
| II.10 | Mowital B30HH | 84 | 13 | 3 | | 64° C. | Hoechst |
| II.11 | Pioloform BM18 | 80 | 18 | 2 | | | Wacker Chemie |
| II.12 | Slec BXL | 78 ± 3 | 29 ± 5 | <4 | | 90° C. | Sekisui Plastics |
| II.13 | Slec BX5 | 74 ± 3 | 24 ± 5 | <4 | | | Sekisui Plastics |

TABLE 2-continued

| Sample | Trade name | Composition | | | | | |
|---|---|---|---|---|---|---|---|
| | | pVi Butyral % | pViOH (%) | pViOAc (2) | M.G. | Tg (°C.) | Firm |
| II.14 | Vinylite LM | | | | | | Bakelite Corp. |
| II.15 | Vinylite XYHL | 56,4 | 42,9 | 0,7 | | | Bakelite Corp. |

After exposure, lamination of a counterfoil and delamination as described in example 1, positive images on the PET support) were obtained for all samples. No pinhole defect was present.

Example 3

The same procedure as described for sample I (example 1) was followed with the difference that otherwise composed layers (1) were used, as shown in table 3:

TABLE 3

| Sample | layer 1 | Composition |
|---|---|---|
| III.1 | $ViCl_2$—AN | Ixan WN91E - Solvay: Vinylidenechloride-acrylonitrile |
| III.2 | $ViCl_2$—X | Ixan PNE613 - Solvay: Vinylidenechloride - X |
| III.3 | $ViCl_2$ + AN/ $ViCl_2$—X (80/20→0/100) | Viclan A85 - ICI: $ViCl_2$/AN 85,4/14,6 ratio's 80/20→0/100 Ixan PNE256 - Solvay: $ViCl_2$/X |

After exposure, lamination of a counterfoil and delamination as described in example 1, positive images (with regard to PET support) without pinholes were obtained with all samples.

Example 4

The same procedure as described for sample I (example 1) was followed with the difference that additives were added to the coating solution of layer (2). The additives are shown in table 4.

TABLE 4

| Sample | Product information |
|---|---|
| V.1 | Cu-phtalocyanine (pigment) |
| V.2 | Aerosil R812: $SiO_2$ (Degussa) Ø7 mm (solid particles) |
| V.3 | Laponite RD $(N_2MgLi)SiO_2$ Ø<250 nm (solid particles) |
| V.4 | Laponite RDS (solid particles) |
| V.5 | Wacker HDK H30 (solid particles) |
| V.6 | Bentone SD3 (solid particles) |
| V.7 | Triazine (thermo-acid) |
| V.8 | nitrocellulose (thickening agent) |
| V.9 | $ViCl_2$—AN:Bu/MS 50/50–75/25 (Viclon A85) (Cl-polymer) |
| V.10 | dibutylphthalate (plasticizer) |
| V.11 | Baysilon Lackadditiv MA (coating aid) |
| V.12 | Fluorad FC430 (coating aid) |
| V.13 | (Wacker)Silicon fluid Lo54 (coating aid) |
| V.14 | Tospearl 103 silica parts Ø0,3μ (solid particles) |
| V.15 | Tospearl 105 silica parts Ø0,5μ (solid particles) |
| V.16 | Seahostar P50: $SiO_2$ Ø0,5μ (solid particles) |

After exposure, lamination of a counterfoil and delamination as described in example 1, positive images on the PET support were obtained with all samples.

Example 5

The same procedure as described for sample I (example 1) was followed with the difference that no laser was used to expose the material. A thermal printing head was used instead.

After lamination of a counterfoil and delamination as described in example 1, a positive image on the PET support without pinholes was obtained.

We claim:

1. Thermal imaging medium comprising a transparent support and the following layers:
   (1) a layer comprising a homopolymer or copolymer comprising at least 60 mole % of monomer units containing covalently bound chlorine,
   (2) a layer containing a homopolymer or copolymer comprising at least 50 mole % of a vinyl acetal monomer unit,
   (3) an image forming layer containing an image forming substance and optionally a compound capable of transforming laser radiation into heat, said compound being the same or different from said image forming substance,
   (4) a release layer,
   (5) a thermoadhesive layer.

2. Thermal imaging medium according to claim 1 wherein said layer (1) comprises a homopolymer or copolymer comprising at least 80 mole % of monomer units containing covalently bound chlorine.

3. Thermal imaging medium according to claim 1 wherein said layer (2) contains a homopolymer or copolymer comprising at least 70 mole % of a vinyl acetal monomer unit.

4. Thermal imaging medium according to claim 1 wherein said vinyl acetal monomer is vinyl butyral.

5. Thermal imaging medium according to claim 1 wherein said image forming substance is a pigment.

6. Thermal imaging medium according to claim 5 wherein said pigment is carbon black, being at the same time said compound capable of transforming laser radiation into heat.

7. Process for the formation of a heat mode image, comprising the following steps:
   (a) exposing information-wise to laser radiation or to heat generated by a thermal head a thermal imaging medium comprising a transparent support and the following layers:
      (1) a layer comprising a homopolymer or copolymer comprising at least 60 mole % of monomer units containing covalently bound chlorine,
      (2) a layer containing a homopolymer or copolymer comprising at least 50 mole % of a vinyl acetal monomer unit,
      (3) an image forming layer containing an image forming substance and, in case of laser exposure in step (a), a compound capable of transforming laser radiation into heat, said compound being the same or different from said image forming substance,
      (4) a release layer,
      (5) a thermoadhesive layer,
   (b) laminating a cover sheet to said thermoadhesive layer (5), with the proviso that the order of steps (a) and (b) can be reversed, and
   (c) peeling apart said support and said cover sheet whereby at least the layers (1), (2) and (3) adhere to said support in the information-wise non-exposed parts, and whereby the layers (2) (3), (4) and (5) adhere to said cover sheet in the information-wise exposed parts thus forming a positive image on said support and a negative image on said cover sheet.

8. Process according to claim 7 wherein said layer (1) comprises a homopolymer or copolymer comprising at least 80 mole % of monomer units containing covalently bound chlorine.

9. Process according to claim 7 wherein said layer (2) contains a homopolymer or copolymer comprising at least 70 mole % of a vinyl acetal monomer unit.

10. Process according to claim 7 wherein said vinyl acetal monomer is vinyl butyral.

11. Process according to claim 7 wherein said image forming substance is a pigment.

12. Process according to claim 11 wherein said pigment is carbon black.

13. Process according to claim 7 wherein said information-wise exposure to laser radiation is performed by an infra-red laser.

14. Process according to claim 13 wherein said infra-red laser is a Nd-YAG laser.

* * * * *